US008291889B2

(12) United States Patent
Shafer et al.

(10) Patent No.: US 8,291,889 B2
(45) Date of Patent: Oct. 23, 2012

(54) PRESSURE CONTROL IN LOW STATIC LEAK FUEL SYSTEM

(75) Inventors: Scott F. Shafer, Morton, IL (US); Jeffrey DePayva, Dunlap, IL (US); Daniel R. Puckett, Peoria, IL (US); Amy S. Johanson, Normal, IL (US); Kenneth C. Adams, Dunlap, IL (US); Benjamin R. Tower, Varna, IL (US); Jason Z. Li, Peoria, IL (US); Jayaraman Venkataraghavan, Dunlap, IL (US); Michael D. Gerstner, Peoria, IL (US); Michael C. Long, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 839 days.

(21) Appl. No.: 12/437,028

(22) Filed: May 7, 2009

(65) Prior Publication Data

US 2010/0282212 A1 Nov. 11, 2010

(51) Int. Cl.
*F02M 59/36* (2006.01)

(52) U.S. Cl. ..... 123/458; 123/511; 123/514; 701/103; 701/110

(58) Field of Classification Search ..... 123/467, 123/458, 506, 510, 511, 512, 514, 198 D, 123/493, 179.16, 179.17; 137/505.12, 505.14, 137/505.15, 522, 529; 701/112
See application file for complete search history.

(56) References Cited

U.S. PATENT DOCUMENTS

| | | | | |
|---|---|---|---|---|
| 3,643,635 | A * | 2/1972 | Milam | 123/676 |
| 5,069,111 | A * | 12/1991 | Loffler et al. | 91/516 |
| 5,074,272 | A * | 12/1991 | Bostick et al. | 123/514 |
| 5,230,364 | A * | 7/1993 | Leng et al. | 137/514 |
| 5,295,469 | A | 3/1994 | Kariya et al. | |
| 5,311,850 | A | 5/1994 | Martin | |
| 5,467,797 | A * | 11/1995 | Seetharaman et al. | 137/599.07 |
| 5,537,980 | A * | 7/1996 | Yamamoto | 123/447 |
| 5,558,063 | A * | 9/1996 | Minagawa et al. | 123/457 |
| 5,577,479 | A | 11/1996 | Popp | |
| 5,711,274 | A | 1/1998 | Drummer | |
| 5,718,207 | A * | 2/1998 | Ito | 123/497 |
| 6,067,963 | A * | 5/2000 | Oi et al. | 123/458 |
| 6,189,509 | B1 | 2/2001 | Froment | |
| 6,244,253 | B1 | 6/2001 | Haeberer et al. | |

(Continued)

FOREIGN PATENT DOCUMENTS

WO WO 2004/083695 A1 9/2004

*Primary Examiner* — Thomas Moulis
(74) *Attorney, Agent, or Firm* — Liell & McNeil

(57) ABSTRACT

A pressure relief valve includes a valve body having a valve seat fluidly positioned between an inlet and an outlet. A valve member is movable among a first position, a second position, and a third position. The valve member is in contact with the valve seat and fluidly blocks the inlet from the outlet at the first position. At the second position of the valve member, the inlet is fluidly connected to the outlet via a small flow area. The inlet is fluidly connected to the outlet via a large flow area when the valve member is at the third position. An electrical actuator is attached to the valve body and is operably coupled to move the valve member when energized. The valve member includes an opening hydraulic surface exposed to fluid pressure in the inlet when at the first position. A spring is operably positioned to bias the valve member toward the second position when the valve member is at the third position.

14 Claims, 6 Drawing Sheets

U.S. PATENT DOCUMENTS 6,367,455 B2 * 4/2002 Hirata et al. ..... 123/497
6,408,825 B1 * 6/2002 Enoki et al. ..... 123/467
6,715,468 B2 4/2004 Uchiyama et al.
6,895,936 B2 5/2005 Kuroda
6,915,787 B2 * 7/2005 Yoshioka et al. ..... 123/457
7,066,152 B2 * 6/2006 Stroia et al. ..... 123/467
7,216,669 B2 5/2007 Braeuer et al.
7,270,113 B2 9/2007 Hervault et al.
7,392,792 B2 7/2008 Puckett
7,481,204 B2 * 1/2009 Sullivan ..... 123/514
7,740,006 B2 * 6/2010 Ikeya ..... 123/506
8,061,331 B2 * 11/2011 Tsukada et al. ..... 123/458
8,100,109 B2 * 1/2012 Nakata ..... 123/446
8,171,916 B2 * 5/2012 Nishibu et al. ..... 123/458
2004/0025845 A1 2/2004 Magel
2006/0231080 A1 10/2006 Tomatsuri et al.
2006/0243252 A1 11/2006 Eisenmenger et al.
2007/0084443 A1 * 4/2007 Nonoyama et al. ..... 123/458
2007/0101968 A1 * 5/2007 Gibson et al. ..... 123/300
2007/0125343 A1 6/2007 Hayakawa
2008/0059039 A1 * 3/2008 Nakagawa et al. ..... 701/99
2008/0092852 A1 4/2008 Bucher et al.
2009/0188469 A1 * 7/2009 Tsukada et al. ..... 123/456
2009/0240417 A1 * 9/2009 Fushiki et al. ..... 701/103

* cited by examiner

PRESSURE CONTROL IN LOW STATIC LEAK FUEL SYSTEM

TECHNICAL FIELD

The present disclosure relates generally to pressure control in common rail fuel systems, and more particularly to a means for controlling rail pressure in low static leak fuel systems.

BACKGROUND

Common rail fuel systems typically include a fuel source and fuel delivery components for supplying fuel directly into cylinders of an internal combustion engine by way of a common rail. Fuel within the common rail may be pressurized to a relatively high pressure using one or more pumps, and may be delivered to fuel injectors through a plurality of individual fuel supply passages. A control system may be associated with the fuel system to monitor and control operation of one or more of the fuel system components. Specifically, for example, the control system may be configured to control the high-pressure pump and each of the fuel injectors to control pressurization rates and injection, thus improving performance and control of the engine. Typically, such fuel systems also include some means to protect the system against gross over-pressurization, which may occur due to one or more of an operational, control, or component problem. Often, this protection is provided through the use of a pressure relief valve, which may be mechanically or electronically actuated when rail pressure is above a predetermined maximum operating pressure.

Engineers are constantly seeking improved performance and expanded capabilities for such fuel systems. For example, a low static leak fuel system may provide minimal leakage and, as a result, may improve the overall efficiency, reliability, and durability of common rail fuel systems. However, the lack of static leakage from the fuel system may present a previously unrecognized performance challenge, such that when a reduction in rail pressure is required, the pressure may not be reduced at a desired rate. More specifically, conventionally designed fuel systems, which may allow a tolerable amount of leakage, may increase a reduction rate, or decay rate, of pressure within the rail, whereas the low static leak fuel system may not. As a result, for example, the settle time required for an operational engine having a low static leak fuel system to go from a high load condition, during which relatively high rail pressures are used, to a low load or idle condition, during which relatively low rail pressures are used, may be compromised.

As introduced above, a variety of mechanical and electronic means for preventing over-pressurization within common rail fuel systems are generally known. For example, U.S. Pat. No. 7,392,792 teaches a pressure relief valve that may fluidly connect the common rail to the fuel tank via a fluid passageway to relieve pressure from the fuel system. Although the commonly owned reference is directed to a method for dynamically detecting fuel leakage, a pressure relief valve that may be actuated when rail pressure exceeds a biasing spring force and/or when a solenoid is energized is described. While the reference may effectively reduce or prevent over-pressurization from occurring, it does not recognize a need for controlling rail pressure in low static leak fuel systems.

The present disclosure is directed to one or more of the problems set forth above.

SUMMARY OF THE DISCLOSURE

In one aspect, a pressure relief valve includes a valve body having a valve seat fluidly positioned between an inlet and an outlet. A valve member is movable among a first position, a second position, and a thud position. The valve member is in contact with the valve seat and fluidly blocks the inlet from the outlet at the first position. At the second position of the valve member, the inlet is fluidly connected to the outlet via a small flow area. The inlet is fluidly connected to the outlet via a large flow area when the valve member is at the third position. An electrical actuator is attached to the valve body and is operably coupled to move the valve member when energized. The valve member includes an opening hydraulic surface exposed to fluid pressure in the inlet when at the first position. A first spring is operably positioned to bias the valve member toward the second position when the valve member is at the third position.

In another aspect, an engine system includes a low static leak fuel system. The low static leak fuel system includes a common rail and a plurality of fuel injectors fluidly connected to the common rail via individual branch passages. A variable delivery high-pressure pump includes an outlet fluidly connected to an inlet of the common rail. The low static leak fuel system also includes a fuel tank and a fuel transfer pump having an inlet fluidly connected to the fuel tank and an outlet fluidly connected to an inlet of the variable delivery high-pressure pump. A pressure relief subsystem includes an electrical actuator and has a first configuration, a second configuration, and a third configuration. In the first configuration, fluid communication between the common rail and the fuel tank is closed. In the second configuration, the common rail is in fluid communication with the fuel tank via a small flow area. In the third configuration, the common rail is in fluid communication with the fuel tank via a large flow area. The pressure relief subsystem is hydraulically moved from the first configuration to the third configuration in response to fluid pressure in the common rail exceeding a predetermined pressure that is greater than a predetermined maximum operating pressure of the fuel system. An electronic controller is in individual control communication with each of the pressure relief subsystem, the variable delivery high pressure pump, and the plurality of fuel injectors, and is configured to communicate a pressure decay control signal to the electrical actuator to move the pressure relief subsystem from the first configuration to the second configuration and then back to the first configuration in response to an engine load reduction determination.

In yet another aspect, a method of operating an engine having a low static leak fuel system includes supplying fuel to a common rail by operating a variable delivery high-pressure pump. Fuel is supplied from the common rail to a plurality of fuel injectors via individual branch passages. Fuel is injected from the plurality of fuel injectors directly into respective engine cylinders, and is ignited within the respective engine cylinders. The engine is transitioned from a first high engine load to a first low engine load. This transitioning step including opening and then closing a fluid connection between the common rail and a fuel tank.

DETAILED DESCRIPTION

Figure 1:
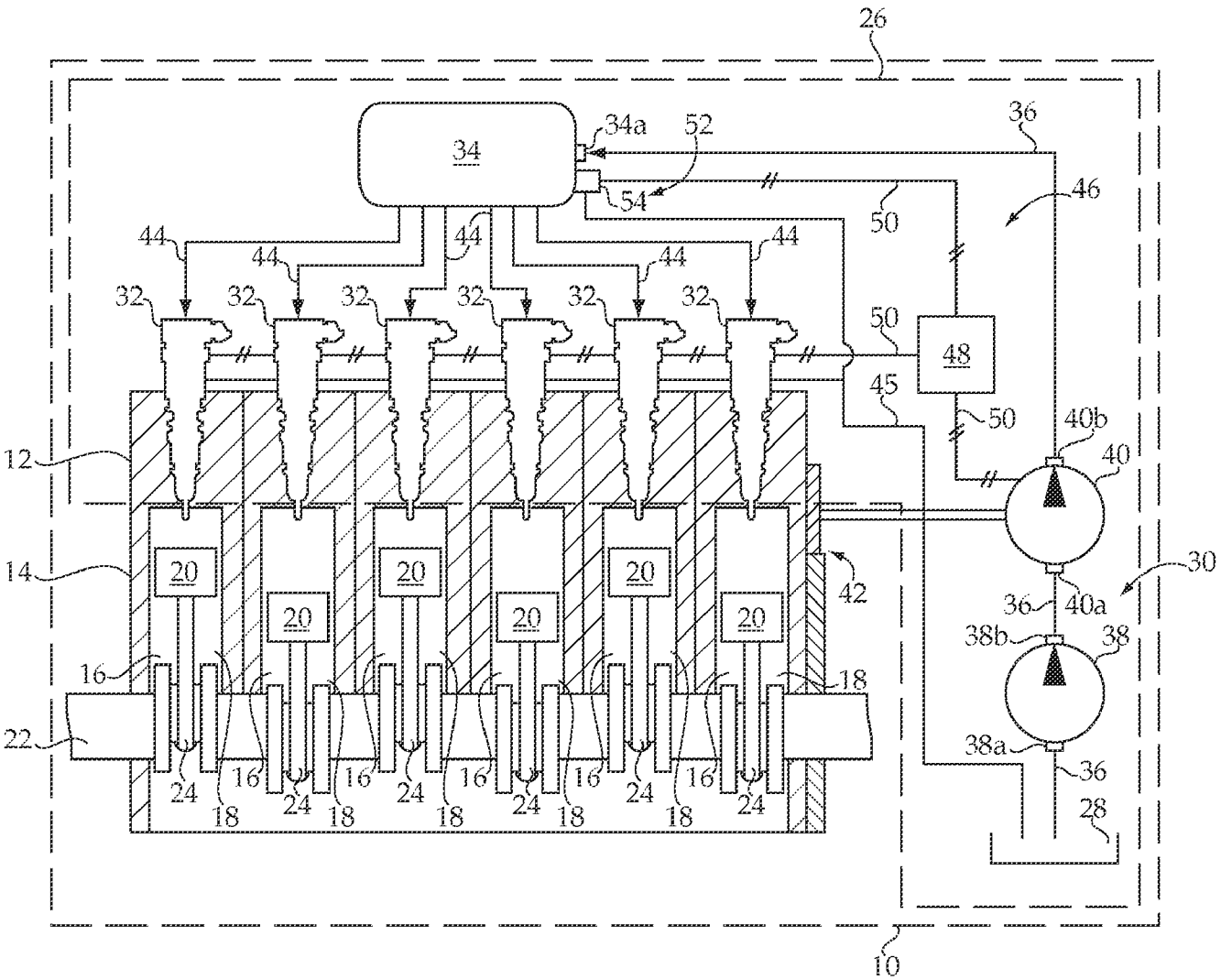
FIG. 1 is a schematic view of an engine system, which includes a low static leak fuel system, according to one aspect of the present disclosure.

Referring to FIG. 1, an engine system 10 may generally include an internal combustion engine 12, such as a compression ignition engine. The internal combustion engine 12 may include an engine block 14 that defines a plurality of cylinders 16, each of which forms a combustion chamber 18. A piston 20 is slidable within each cylinder 16 to compress air within the respective combustion chamber 18. The internal combustion engine 10 also includes a crankshaft 22 that is rotatably disposed within the engine block 14. A connecting rod 24 may connect each piston 20 with the crankshaft 22 such that sliding motion of the pistons 20 within each respective cylinder 16 results in a rotation of the crankshaft 22. Similarly, rotation of the crankshaft 22 may result in linear sliding motion of the pistons 20.

The engine system 10 may also include a low static leak fuel system 26, also referred to as a common rail fuel system, for supplying fuel into each of the combustion chambers 18 dining operation of the internal combustion engine 12. The low static leak fuel system 26, as described herein, may be characterized as such based on a pressure decay from a predetermined maximum operating pressure to a predetermined minimum operating pressure in a particular time. For example, the low static leak fuel system 26 may include a fuel system that transitions from the maximum operating pressure to the minimum operating pressure in greater than about two seconds. As should be appreciated, fuel systems that transition from maximum operating pressure to minimum operating pressure in less than about two seconds may not generally be characterized as exhibiting low static leakage.

The low static leak fuel system 26 may include a fuel tank 28 configured to hold a supply of fuel, and a fuel pumping arrangement 30 configured to pressurize the fuel and direct the pressurized fuel to a plurality of fuel injectors 32 by way of a common rail 34. The fuel pumping arrangement 30 may include one or more pumping devices that function to increase the pressure of the fuel and direct one or more pressurized streams of fuel to the common rail 34 using fuel lines 36. For example, the fuel pumping arrangement 30 may include a fuel transfer pump 38 having an inlet 38*a* fluidly connected to the fuel tank 28, and an outlet 38*b* fluidly connected to an inlet 40*a* of a variable delivery high-pressure pump 40. The variable delivery high-pressure pump 40, which may increase the pressure of the fuel to a range of about 30-300 MPa, may have an outlet 40*b* that is fluidly connected to an inlet 34*a* of the common rail 34. One or both of the fuel transfer pump 38 and the variable delivery high-pressure pump 40 may be operably connected to the internal combustion engine 12 and driven by the crankshaft 22. For example, the variable delivery high-pressure pump 40 may be connected to the crankshaft 22 through a gear train 42.

The fuel injectors 32 may be disposed within a portion of the cylinder block 14, as shown, and may be connected to the common rail 34 via a plurality of individual branch passages 44. Each fuel injector 32 may be operable to inject an amount of pressurized fuel into an associated combustion chamber 18 at predetermined timings, fuel pressures, and fuel flow rates. The timing of fuel injection into the combustion chambers 18 may be synchronized with the motion of the pistons 20. For example, fuel may be injected as piston 20 nears a top-dead-center position in a compression stroke to allow for compression-ignited combustion of the injected fuel. Alternatively, fuel may be injected as piston 20 begins the compression stroke heading towards a top-dead-center position for homogenous charge compression ignition operation. As shown, fuel injectors 32 may also be fluidly connected to fuel tank 28 via one or more drain lines 45.

A control system 46 may be associated with low static leak fuel system 26 and/or engine system 10 to monitor and control the operations of the fuel pumping arrangement 30, fuel injectors 32, and various other components of the fuel system 26. In particular, and according to the exemplary embodiment, the control system 46 may include an electronic controller 48 in communication with the variable delivery high-pressure pump 40 and each of the fuel injectors 32 via communication lines 50. For example, the electronic controller 48 may be configured to control pressurization rates and injection, thus improving performance and control of the internal combustion engine 12. Although a particular embodiment is shown, it should be appreciated that the control system 46 may be configured to provide any desired level of control, and may include any number of components and/or devices, such as, for example, sensors, useful in providing the desired control.

The electronic controller 48 may be of standard design and may generally include a processor, such as for example a central processing unit, a memory, and an input/output circuit that facilitates communication internal and external to the electronic controller 48. The central processing unit may control operation of the electronic controller 48 by executing operating instructions, such as, for example, programming code stored in memory, wherein operations may be initiated internally or externally to the electronic controller 48. A control scheme may be utilized that monitors outputs of systems or devices, such as, for example, sensors, actuators or control units, via the input/output circuit to control inputs to various other systems or devices. For instance, the electronic controller 48 may be in control communication with each of the fuel injectors 32 or, more specifically, actuators thereof via communication lines 50 to deliver the required amount of fuel at the correct time. Further, the electronic controller 48 may communicate control signals to variable delivery high-pressure pump 40 via communication lines 50 to control pressure and output of the high-pressure pump 40 to common rail 34.

Figure 2:
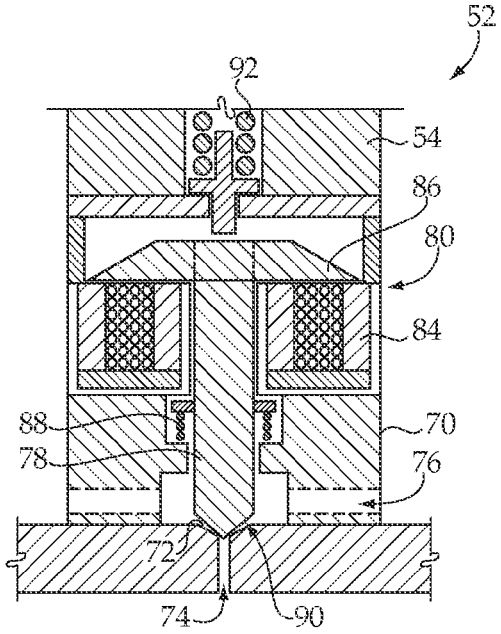
FIG. 2 is a sectioned view through a two-stage pressure relief valve for use with the engine system of FIG. 1, the two-stage pressure relief valve being shown in a first configuration.

The engine system 10 or, more particularly, the low static leak fuel system 26 may also include a pressure relief subsystem 52. The pressure relief subsystem 52, generally speaking, may include a means for opening and closing a fluid connection between the common rail 34 and the fuel tank 28, or other drain. According to one embodiment, the pressure relief subsystem 52 may include a two-stage pressure relief valve 54, which may receive electronic control signals from electronic controller 48. The two-stage pressure relief valve 54, shown in a first configuration in FIG. 2, may generally include a valve body 70 having a valve seat 72 fluidly positioned between an inlet 74, which may be fluidly connected with the common rail 34, and an outlet 76, which may be fluidly connected to the fuel tank 28 via drain lines 45. A valve member 78 may be movable, relative to the valve seat 72, among a plurality of positions, including a first position, which is shown. Specifically, at the first position, the valve member 78 may be in contact with the valve seat 72 and, therefore, may fluidly block the inlet 74 from the outlet 76.

According to one embodiment, an electrical actuator 80 may be attached to the valve body 70 and operably coupled to move the valve member 78 when energized. The electrical actuator 80 may include a solenoid 84 with an armature 86 that is coupled to move the valve member 78 toward the first position when the solenoid 84 is energized. Specifically, the solenoid 84 may be energized to move valve member 78 into the first position against a spring force provided by a second spring 88, which may be considered a weak spring relative to a first spring 92. Alternatively, or additionally, the solenoid 84 may be energized to urge the valve member 78 against an opening force acting on an opening hydraulic surface 90 of the valve member 78. Further, such movement may effectively decouple the valve member 78 from a first spring 92, which may be considered a strong spring relative to second or weak spring 88, and is discussed later in greater detail. Although the electrical actuator 80 is depicted as including a solenoid 84 and armature 86, it should be appreciated that the electrical actuator 80 may include any of a variety of known actuators. For example, the electrical actuator 80 may include a piezo electrical actuator having a piezo stack that changes in length in response to control signals, or voltages, received on communication lines 50 from electronic controller 48.

Figure 3:
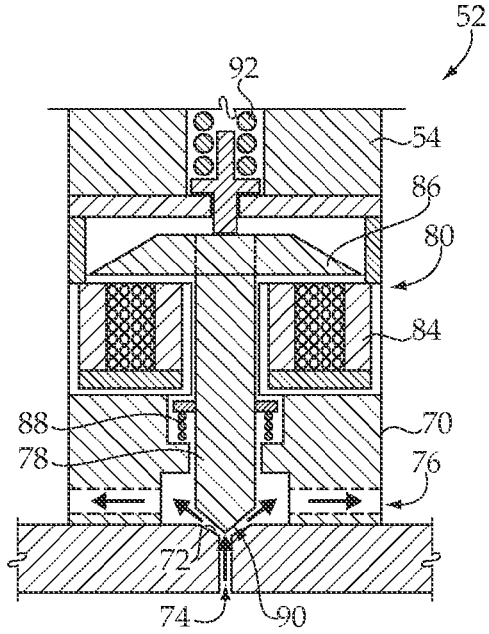
FIG. 3 is a sectioned view of the two-stage pressure relief valve of FIG. 2, the two-stage pressure relief valve being shown in a second configuration.

Turning now to FIG. 3, the two-stage pressure relief valve 54 is shown in a second configuration. In the second configuration, the electrical actuator 80 may be de-energized, thus allowing the weak spring 88 to bias the valve member 78 into a second, or slightly opened, position. Specifically, the weak spring 88 may urge the valve member 78 out of contact with the valve seat 72. Further, fluid pressure in the common rail 34 acting on opening hydraulic surface 90 may urge valve member 78 toward the second position. As a result, the inlet 74 of the two-stage pressure relief valve 54 may be fluidly connected to the outlet 76 of the valve 54 via a small flow area, as shown. In addition, the valve member 78 may be effectively coupled with the strong spring 92 in the second configuration of the two-stage pressure relief valve 54. It should be appreciated that the strong spring 92 may only be characterized as "strong" relative to the weak spring 88. Specifically, the strong spring 92 may include a greater pre-load than the weak spring 88. Similarly, the weak spring 88 may be considered "weak" only with respect to the strong spring 92.

Figure 4:
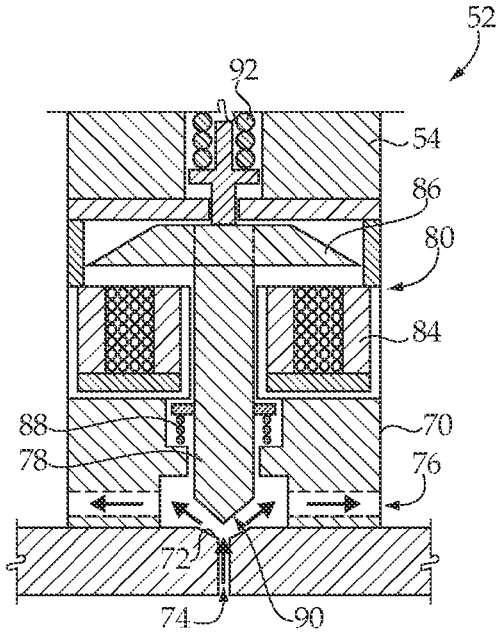
FIG. 4 is a sectioned view of the two-stage pressure relief valve of FIG. 2, the two-stage pressure relief valve being shown in a third configuration.

A third configuration of the two-stage pressure relief valve 54 is shown generally in FIG. 4. In the third configuration of the two-stage pressure relief valve 54, the inlet 74 may be fluidly connected to the outlet 76 via a large flow area, as shown. More specifically, the electrical actuator 80 may be de-energized, allowing a predetermined fluid pressure level within the common rail 34 to urge the valve member 78 upward and into a third position, against a predetermined pre-load of strong spring 92. It should be appreciated that, in the thud position, the valve member 78 may be further out of contact with the valve seat 72 than it is in the second position and, as a result, the flow area provided in the third configuration of the two-stage pressure relief valve 54 may be greater than that provided in the second configuration. According to one embodiment, the two-stage pressure relief valve 54 may be configured to allow movement of the valve member 78 into the thud position when fluid pressure in the common rail 34 exceeds a predetermined pressure that is greater than a predetermined maximum operating pressure of the low static leak fuel system 26.

Figure 5:
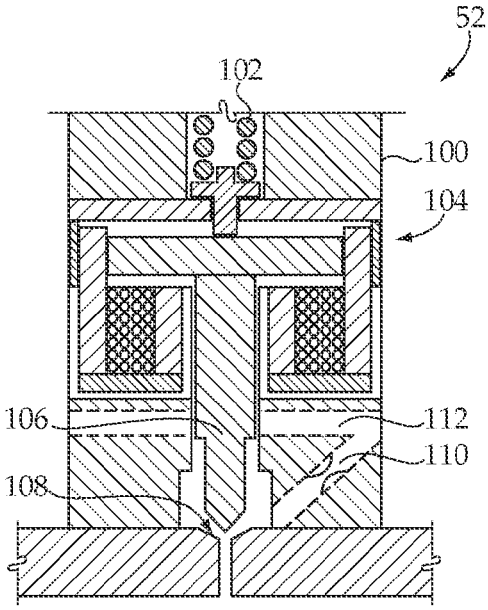
FIG. 5 is a sectioned view through an alternative embodiment of the two-stage pressure relief valve depicted in FIGS. 2-4.

Alternatively, as shown in FIG. 5, a two-stage pressure relief valve 100 for use with the present disclosure may be provided with only one spring 102. Specifically, the two-stage pressure relief valve 100 may be similar to the two-stage pressure relief valve 54 of FIGS. 2-4, but may be biased to a slightly open position in response to pressure within the common rail 34, rather than in response to a spring load. When electrical actuator 104 is de-energized, valve member 106 may be moved out of contact with valve seat 108 and into a moderate flow position, which may be similar to the second position described above. This moderate flow position, which may allow flow through a first outlet 110, may be configured to provide damping of significant rail pressure changes, while allowing the common rail 34 to build and maintain sufficient rail pressure. As rail pressure increases, such as above a predetermined maximum operating pressure, valve member 106 may be moved further upward, against a spring force provided by spring 102 and into a third position, to allow pressure relief through a second outlet 112.

Figure 6:
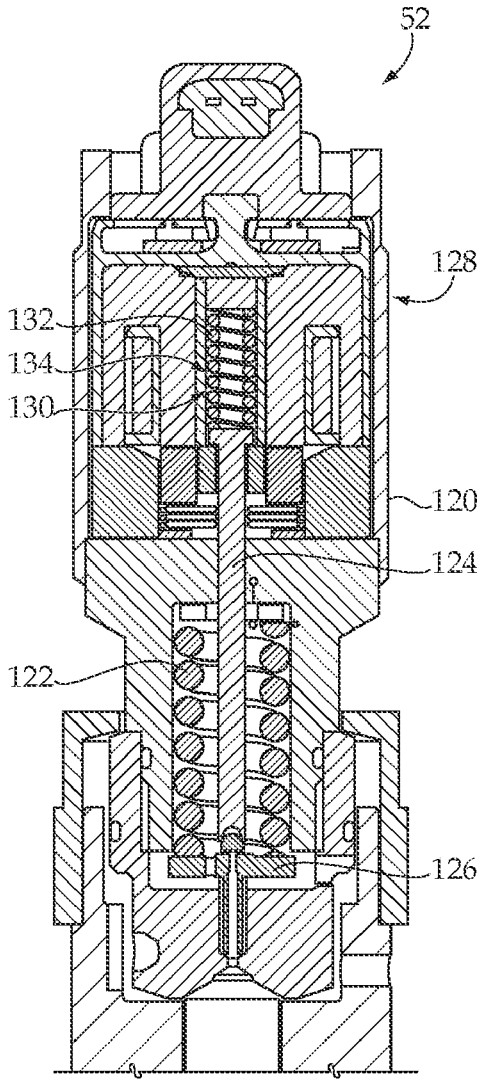
FIG. 6 is a sectioned view through an alternative embodiment of a two-stage pressure relief valve for use with the engine system of FIG. 1.

It should be appreciated that the pressure relief subsystem 54 may include a number of additional or alternative valve configurations, without deviating from the scope of the present disclosure. Although "leaking" pressure relief valves have been shown in FIGS. 2-5, pressure relief valves that are biased to a closed, or "non-leaking," position may also be used. For example, as shown in FIG. 6, the pressure relief subsystem 52 may include an alternative two-stage pressure relief valve 120. According to the alternative embodiment, a spring 122 and/or armature pin 124 may bias valve member 126 toward the first, or closed, position. An electrical actuator 128 may be energized to move armature pin 124 slightly upward, thus allowing rail pressure to move valve member 126 into the second position. An overtravel mechanism 130 may allow the armature pin 124 to assume an overtravel position when the valve member 126 is moved into the third position. Specifically, when rail pressure increases above a predetermined maximum operating pressure, valve member 126 may be moved upward, against a predetermined preload of spring 122, thus moving armature pin 124 against a spring 132 positioned within a solenoid spring bore 134.

Figure 7:
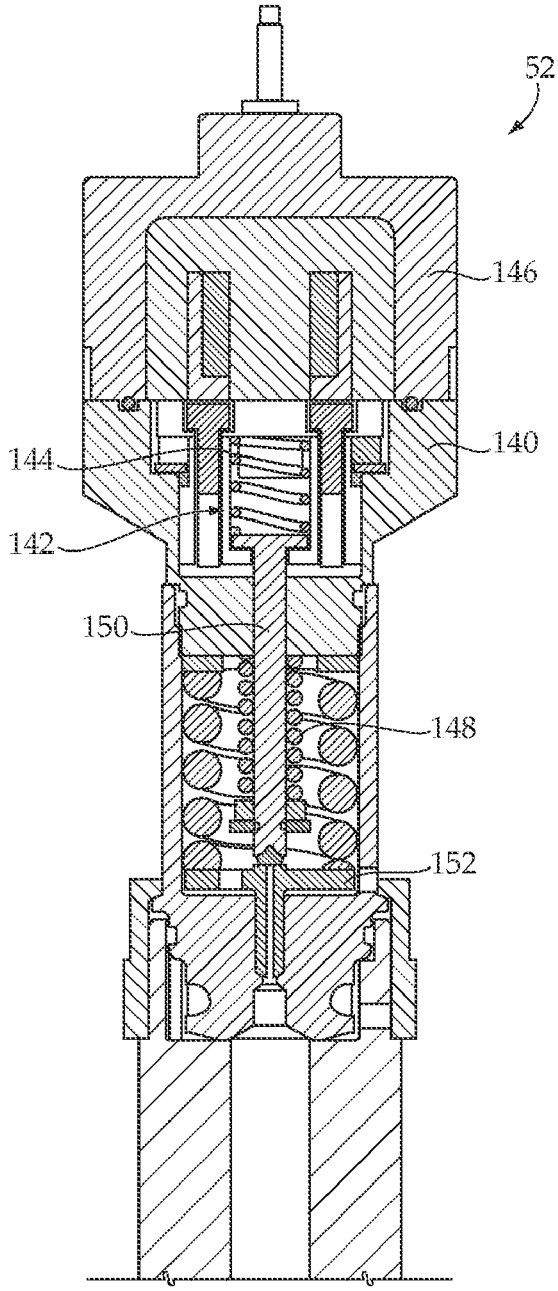
FIG. 7 is a sectioned view through another alternative embodiment of a two-stage pressure relief valve for use with the engine system of FIG. 1.

As should be appreciated, the overtravel mechanism 130 may allow the armature pin 124 to travel beyond its positions effected by the electrical actuator 128 so that the armature pin 124 does not limit movement of the valve member 126. Although a particular embodiment is shown, it should be appreciated that alternative overtravel mechanisms may be used with pressure relief valve 120, or alternative pressure relief valves. For example, as shown in FIG. 7, a two-stage pressure relief valve 140 may include an overtravel mechanism 142 that includes an armature pin coupling spring 144 and, as shown, does not require a spring bore within solenoid 146. Pressure relief valve 140, which is similar to pressure relief valve 120 of FIG. 6, may also include a solenoid preload spring 148 for biasing armature pin 150 toward valve member 152.

Figure 8:
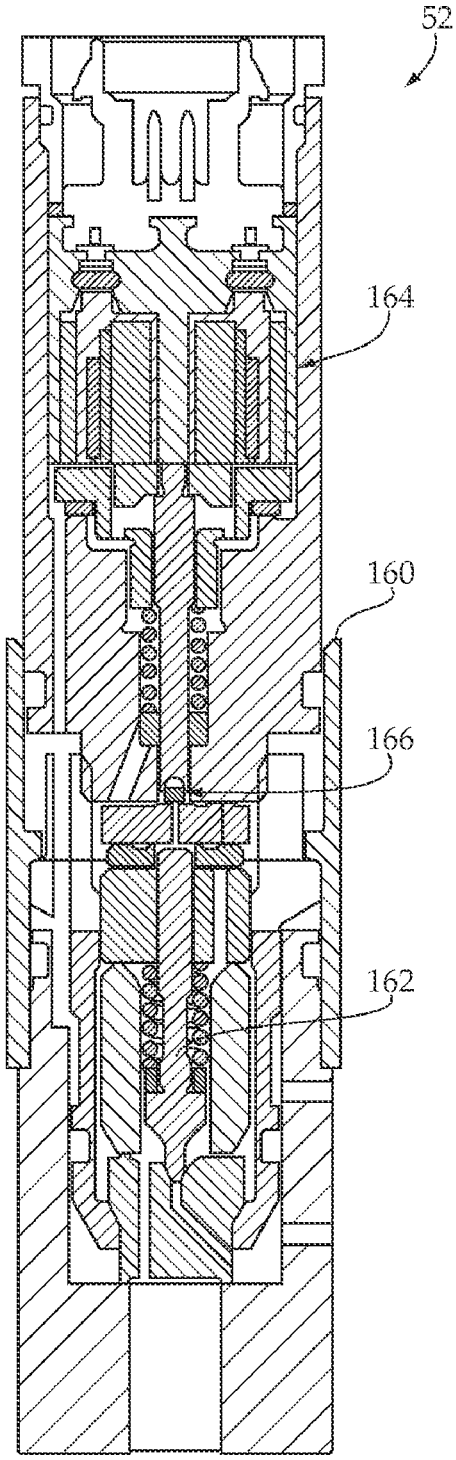
FIG. 8 is a sectioned view through yet an alternative embodiment of a two-stage pressure relief valve for use with the engine system of FIG. 1.

According to yet another alternative embodiment, shown in FIG. 8, the pressure relief subsystem 52 may include a two-stage pressure relief valve 160 that operates similarly to a fuel injector. Unlike a fuel injector check valve, however, a check valve 162 of the two-stage pressure relief valve 160 may open into a drain line, such as the drain lines 45 shown in FIG. 1, rather than into a cylinder. Specifically, upon actuation of the check valve 162, such as by energizing an electrical actuator 164, a fluid connection between the common rail 34 and tank 28 may be opened to selectively relieve pressure within the common rail 34. In addition, sufficiently high pressure below a small pilot valve 166 may cause the valve 166 to open and, thus, drain fuel without actuation of the electrical actuator 164.

It should also be appreciated that actuation of the electrical actuator 80 may be controlled via control signals communicated from the electronic controller 48. Such control signals may be generated responsive to conditions of the low static leak fuel system 26 and/or the engine system 10. For example, control signals may be communicated to the two-stage pressure relief valve 54 in response to sensors or load determinations. For example, a pressure sensor (not shown) may be configured to sense a pressure of fuel within the common rail 34. In addition, sensors may be configured to sense one or more different or additional parameters of the fuel, such as, for example, temperature, viscosity, flow rate, or any other parameter known in the an. Sensors, or other devices, may similarly be provided to detect conditions or parameters of the engine system 10. Such information may be communicated to the electronic controller 48 and used to monitor and/or control operation of the engine system 10 and/or low static leak fuel system 26.

Figure 9A:
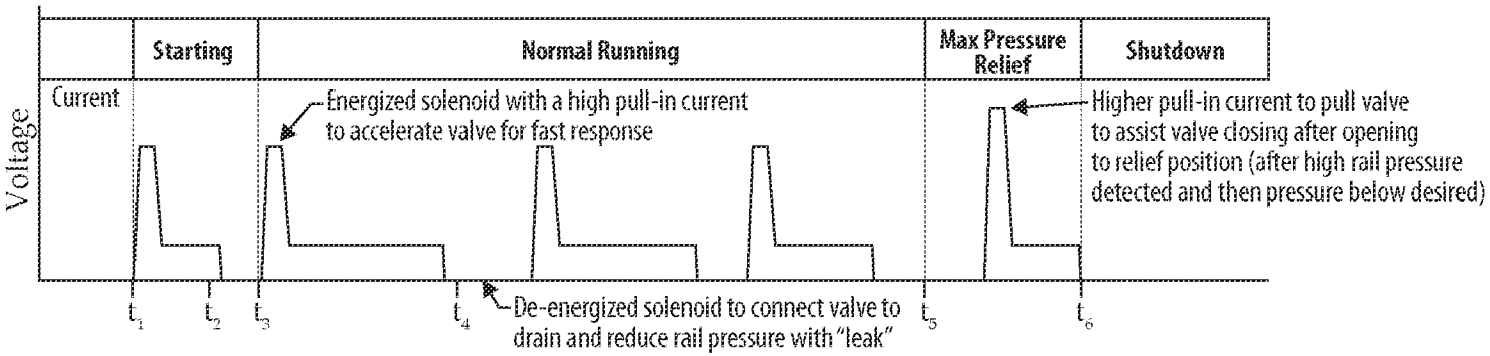
FIGS. 9*a*-9*d* are graphs of actuator voltage, valve position, flow area schedule, and rail pressure versus time for an exemplary engine operation, according to one embodiment of the present disclosure.
Figure 9B:
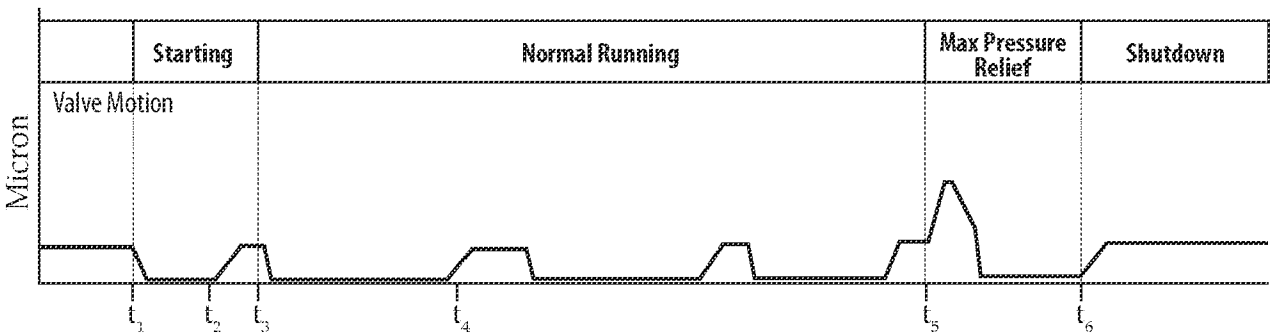
Figure 9C:
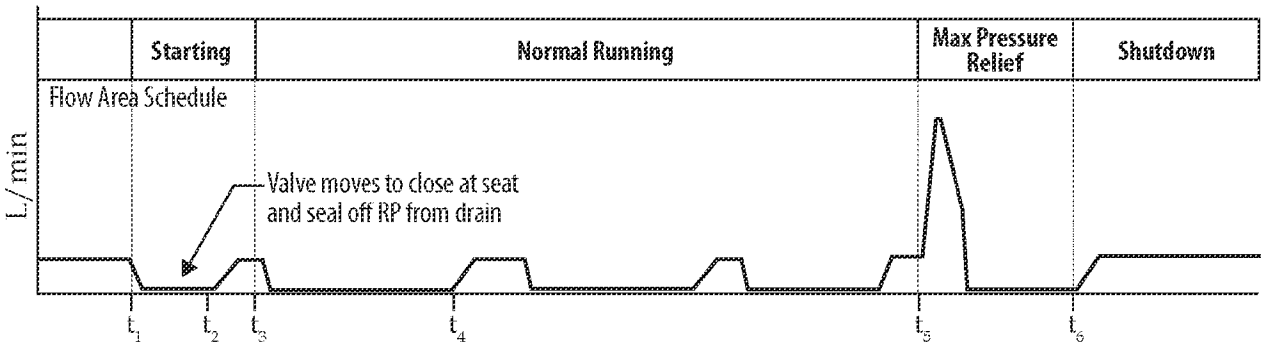
Figure 9D:
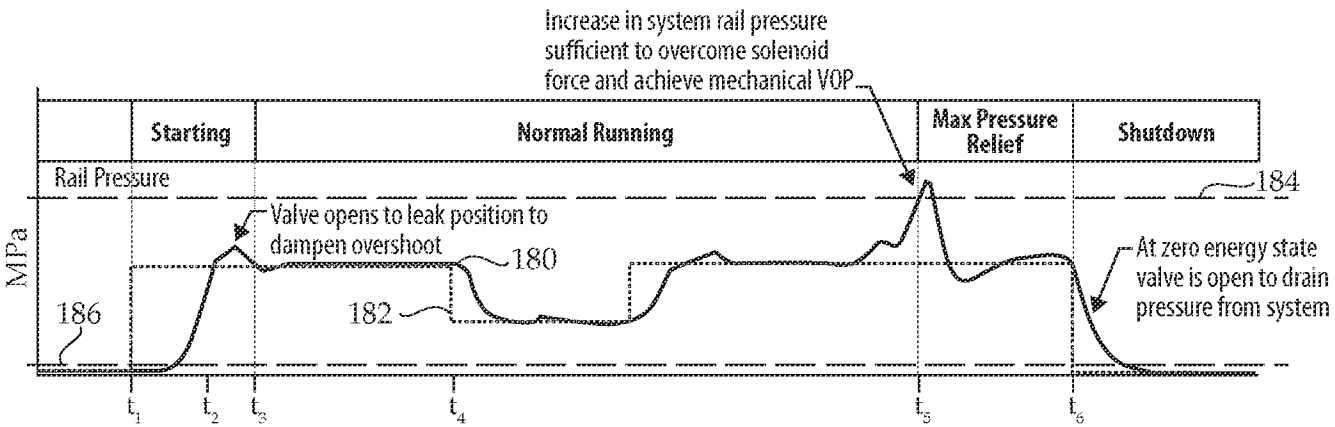

Referring generally to the graphs of FIGS. 9*a*-9*d*, and also referencing FIGS. 1-4, an exemplary operation of the engine system 10 with respect to key pressures and operation of the two-stage pressure relief valve 54 is shown. At time $t_1$, a starting process of the internal combustion engine 12 may be initiated using known starting means. As shown in FIG. 9*d*, it may be desirable to increase, and maintain, a current rail pressure 180 at or near a desired rail pressure 182 during the starting process, and throughout operation of the internal combustion engine 12. For example, at time $t_1$, the two-stage pressure relief valve 54 may be moved to the first configuration, shown in FIG. 2, by energizing the electrical actuator 80, as reflected in FIG. 9*a*. By moving the valve member 78 to close valve seat 72, as shown in FIG. 9*b* and described above, rail pressure may be effectively sealed from the drain, or fuel tank 28, thus allowing the current rail pressure 180 to increase toward the desired rail pressure 182.

As current rail pressure 180 quickly approaches the desired rail pressure 182 near time $t_2$, the two-stage pressure relief valve 54 may be moved into the second configuration of FIG. 3 to "leak" and, as a result, dampen an overshoot. For example, the electronic controller 48 may communicate a pressure overshoot control signal to the electrical actuator 80 to move the valve member 78 from the first position to the second position, and then back to the first position, in response to an engine load increase determination. Specifically, the electrical actuator 80 may be briefly de-energized, thus allowing the valve member 78 to move out of contact with the valve seat 72 using the spring force of weak spring 88 or an opening force acting on the opening hydraulic surface 90 of the valve member 78. While briefly in a slightly opened position, the two-stage pressure relief valve 54 may open a small flow area fluid connection between the common rail 34 and the fuel tank 28, as illustrated in the graph of FIG. 9*c*, to reduce rail pressure. According to the alternative two-stage pressure relief valve 120 of FIG. 6, a similar movement of valve member 126 may be effected by energizing the electrical actuator 128 to move the valve member 126 to a slightly opened position, and then de-energizing the electrical actuator 128 to allow spring 122 to bias the valve member 126 to a closed position.

Between times $t_3$ and $t_6$, the internal combustion engine 12 may transition from a high load condition to a low load condition. When this occurs, as shown at time $t_4$, the desired rail pressure 182 may drop well below the current rail pressure 180. To more quickly reduce the current rail pressure 180, the electronic controller 48 may communicate a pressure decay control signal, or parasitic loss control signal, to the electrical actuator 80 to move the valve member 78 from the first position to the second position, and then back to the first position, in response to the engine load reduction determination. As described above, when the electrical actuator 80 is briefly de-energized, the two-stage pressure relief valve 54 may fluidly connect the common rail 34 and fuel tank 28 via a small flow area to reduce the current rail pressure 180. According to the alternative embodiment of FIG. 6, the current rail pressure 180 may be reduced by energizing the electrical actuator 128 to open a small flow area fluid connection, and then de-energizing the electrical actuator 128 to close the fluid connection.

As shown near time $t_5$, current rail pressure 180 may increase above a predetermined maximum operating pressure 184 in the common rail 34. Such a gross over-pressurization may occur due to one or more of an operational, control, or component issue. To protect the low static leak fuel system 26 from damage, in such an over-pressurized state, the two-stage pressure relief valve 54 may be moved to the third configuration of FIG. 4, as reflected in graphs 9*a*-9*d*. Particularly, the increase in current rail pressure 180 may be sufficient to urge the valve member 78 out of contact with the valve seat 72, and into the third position, against the predetermined pre-load of strong spring 92. As a result, a large flow area through the two-stage pressure relief valve 54 may be opened to reduce pressure in the common rail 34 below the predetermined maximum operating pressure 184.

The large flow area, as should be appreciated, may be greater than the flow area opened in the second configuration of the two-stage pressure relief valve 54. Precise dimensions of both flow areas, as should be appreciated, may be selected based on desired performance of the two-stage pressure relief valve 54. For example, if the small flow area is too large, the valve 54 may not provide the desired rail pressure control. If, however, the small flow area is too small, the valve 54 may not provide the ability to precisely control rail pressure within desired times. Alternatively, the large flow area may be configured to quickly dump rail pressure, rather than provide a more controlled leakage.

At time $t_6$, the internal combustion engine 12 may be shut down, thus reducing the desired rail pressure 182, as shown. To relieve rail pressure from the low static leak fuel system 26 when the internal combustion engine 12 is shut down, the electronic controller 48 may communicate a depressurization control signal to the electrical actuator 80 to move the valve member 78 from the first position to the second position in response to an engine off determination. As a result, the two-stage pressure relief valve 54 may be opened to drain pressure from the fuel system 26 toward a predetermined minimum operating pressure 186. By relieving the low static leak fuel system 26 of the current pressure, maintenance or repair of the fuel system 26, when the internal combustion engine 12 is off, may be more safely performed.

Although the pressure relief subsystem 52 is exemplified as including the two-stage pressure relief valve 54 (or valves 100, 120, 140, or 160), it should be appreciated that the functions described herein with respect to the two-stage pressure relief valve 54 may be performed using two or more pressure control components. For example, the pressure relief subsystem 52 may include a first valve that may be configured to provide pressure relief to reduce over-pressurization in the fuel system 26, such as by opening the first valve in response to rail pressure exceeding a maximum operating pressure. The pressure relief subsystem 52 may also include a second valve, which may be electronically controlled to vent rail pressure at certain desired times, such as in some of the situations described above, to assist in rail pressure control. Specifically, the second valve may provide fast action and precise operation to allow development and exploitation of comprehensive fuel control algorithms, particularly for use with low static leak fuel system 26. For example, by monitoring rail pressure, engine conditions, and other parameters, such an electronically controlled pressure relief device may be used to more quickly and precisely synchronize the current rail pressure 180 with the desired rail pressure 182.

Industrial Applicability

The present disclosure may find potential application to fuel systems for internal combustion engines, and especially to fuel systems for compression ignition engines. Further, the present disclosure may be particularly applicable to common rail fuel systems exhibiting low static leakage. Yet further, the present disclosure may be applicable to low static leak fuel systems that require acceptable fuel pressure settle times.

Referring generally to FIGS. 1-9, an engine system 10 may include an internal combustion engine 12 having an engine block 14 that defines a plurality of cylinders 16. A piston 20 is slidable within each cylinder 16 and connected to a crankshaft 22, such that linear movement of the piston 20 results in rotation of the crankshaft 22, while rotational movement of the crankshaft 22 results in linear sliding motion of the pistons 20. The engine system 10 may also include a low static leak fuel system 26 for supplying fuel into each cylinder 16 at desired times such that the injected fuel and compressed air are ignited to produce mechanical energy. However, the engine 12 need not necessarily be a compression ignition engine as illustrated. The low static leak fuel system 26 may include a fuel tank 28 configured to hold a supply of fuel, and a fuel pumping arrangement 30 configured to pressurize the fuel and direct the pressurized fuel to a plurality of fuel injectors 32 by way of a common rail 34. A control system 46 may be associated with low static leak fuel system 26 and/or engine system 10 to monitor and control the operations of the fuel pumping arrangement 30, fuel injectors 32, and various other components of the fuel system 26.

The low static leak fuel system 26 may provide minimal leakage and, as a result, may improve the overall efficiency, reliability, and durability of the common rail fuel system 26. However, the lack of static leakage may present a previously unrecognized performance challenge, such that when a reduction in rail pressure is required, the pressure may not be reduced at a desired rate. More specifically, conventionally designed fuel systems, which allow a tolerable amount of leakage, may increase a reduction rate, or decay rate, of pressure within the rail, whereas the low static leak fuel system 26 may not. As a result, for example, the settle time required for an operational engine utilizing low static leak fuel system 26 to go from a high load condition, during which relatively high rail pressures are used, to a low load or idle condition, during which relatively low rail pressures are used, may be compromised.

The pressure relief subsystem 52 described herein, which may include a two-stage pressure relief valve 54, may provide passive pressure relief to protect common rail fuel system 26 from over-pressurization, and/or may provide an electrical actuation strategy and means for selectively venting rail pressure at certain desired times to assist in rail pressure control. For example, to protect the low static leak fuel system 26 from damage, in an over-pressurized state, the two-stage pressure relief valve 54 may be moved to an opened configuration, as shown in FIG. 4. Particularly, the increased rail pressure may be sufficient to urge a valve member 78 of the two-stage pressure relief valve 54 out of contact with the valve seat 72 against a pre-load of strong spring 92, thus fluidly connecting the common rail 34 with the fuel tank 28, or other drain. As a result, a large flow area through the two-stage pressure relief valve 54 may be opened to reduce pressure in the common rail 34 below a predetermined maximum operating pressure 184.

Further, during operation of the engine system 10, the internal combustion engine 12 may be transitioned from a first high engine load to a first low engine load. In response, a fluid connection between the common rail 34 and fuel tank 28 may be briefly opened and then closed. Specifically, to more quickly reduce the current rail pressure 180, the electronic controller 48 may communicate a pressure decay control signal, or parasitic loss control signal, to the electrical actuator 80 to move the valve member 78 from the first position to the second position, and then back to the first position, in response to the engine load reduction determination. When the electrical actuator 80 is de-energized, the two-stage pressure relief valve 54 may fluidly connect the common rail 34 and fuel tank 28 via a small flow area to reduce the current rail pressure 180. In addition, when the internal combustion engine 12 is stopped, the fluid connection between the common rail 34 and fuel tank 28 may be opened and then closed to relieve pressure within the low static leak fuel system 26.

Also, during operation, the internal combustion engine 12 may be transitioned from a second low engine load to a second high engine load. In response, the fluid connection between the common rail 34 and fuel tank 28 may be briefly opened and then closed, such as by energizing and then de-energizing the electrical actuator 80, as described above, to dampen an overshoot. Although only a few examples have been provided, it should be appreciated that the pressure relief subsystem 52, which may or may not include a passive over-pressurization relief aspect, may provide control of rail pressure within the low static leak fuel system 26 throughout operation of the internal combustion engine 12. Such precise control may reduce settle times in a variety of operational transitions, such as those described above.

In addition, such a pressure relief subsystem 52 may provide desired "limp home" capabilities. For example, the two-stage pressure relief valve 54, which, when de-energized, may include a biased open position, may maintain a desired reduced rail pressure for operating under such "limp home" conditions. In addition, alternative pressure relief valve 120, which may be biased to a closed position, may facilitate suitable rail pressure for "limp home" conditions. Of course, in such conditions, it is assumed that suitable control of the fuel pumping arrangement 30 and fuel injectors 32 is maintained.

Further, the pressure relief subsystem 52 may be used to reduce torque reversals, and resulting noise, in a gear train 42 powering the variable delivery high-pressure pump 40. Specifically, when operating the internal combustion engine 12 at an idle condition, the variable delivery high-pressure pump 40 may be required to provide a limited amount of fuel. In some circumstances, this may require non-pumping movement of the one or more pistons of the variable delivery high-pressure pump 40. Shortly thereafter, when pumping resumes, torque reversal may result. Such torque reversals may be reduced by pumping fuel to the common rail 34 in excess of a combined fuel injection quantity of the plurality of fuel injectors 32, thus allowing at least one piston to continue pumping. The excess fuel may be returned to the fuel tank 28 by opening the fluid connection between the common rail 34 and the fuel tank 28. As should be appreciated, such control may only be necessary when a low, or minimum, operating pressure is required.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A pressure relief valve, comprising:

a valve body having a valve seat fluidly positioned between an inlet and an outlet;

a valve member being movable among a first position, a second position, and a third position;

the valve member being in contact with the valve seat and fluidly blocking the inlet from the outlet at the first position;

the inlet being fluidly connected to the outlet via a small flow area when the valve member is at the second position;

the inlet being fluidly connected to the outlet via a large flow area when the valve member is at the third position;

an electrical actuator attached to the valve body and being operably coupled to move the valve member when energized;

the valve member having an opening hydraulic surface exposed to fluid pressure in the inlet when at the first position; and a first spring operably positioned to bias the valve member toward the second position when the valve member is at the third position.

2. The pressure relief valve of claim 1, wherein the electrical actuator is a solenoid with an armature coupled to move the valve member toward one of the first position and the second position when the solenoid is energized.

3. The pressure relief valve of claim 2, further including a second spring operably positioned to bias the valve member toward one of the first position and the second position.

4. The pressure relief valve of claim 3, wherein the weak spring biases the valve member toward the second position.

5. The pressure relief valve of claim 3, wherein the weak spring biases the valve member toward the first position.

6. The pressure relief valve of claim 2, wherein the third position of the valve member includes an overtravel position of the armature.

7. An engine system, comprising:

a low static leak fuel system that includes:

a common rail;

a plurality of fuel injectors fluidly connected to the common rail via individual branch passages;

a variable delivery high-pressure pump with an outlet fluidly connected to an inlet of the common rail;

a fuel tank;

a fuel transfer pump with an inlet fluidly connected to the fuel tank, and an outlet fluidly connected to an inlet of the variable delivery high-pressure pump;

a pressure relief subsystem including an electrical actuator, and the pressure relief subsystem having a first configuration, a second configuration, and a third configuration, and fluid communication between the common rail and the fuel tank being closed in the first configuration, and the common rail being in fluid communication with the fuel tank via a small flow area in the second configuration, and the common rail being in fluid communication with the fuel tank via a large flow area in the third configuration, and the pressure relief subsystem being hydraulically moved from the first configuration to the third configuration responsive to fluid pressure in the common rail exceeding a predetermined pressure that is greater than a predetermined maximum operating pressure of the fuel system; and an electronic controller in individual control communication with each of the pressure relief subsystem, the variable delivery high-pressure pump and the plurality of fuel injectors, and the electronic controller being configured to communicate a pressure decay control signal to the electrical actuator to move the pressure relief subsystem from the first configuration to the second configuration and then back to the first configuration responsive to an engine load reduction determination.

8. The engine system of claim 7, wherein the pressure relief subsystem includes a valve with a valve member at a first position in contact with a valve seat in the first configuration, at a second position out of contact with the valve seat in the second configuration, and at a third position further out of contact with the valve seat in the third configuration.

9. The engine system of claim 8, wherein the valve includes:

a first spring positioned to bias the valve member toward one of the first position and the second position; and a second spring positioned to bias the valve member toward the second position when the valve member is at the third position.

10. The engine system of claim 9, wherein the electronic controller is configured to communicate a pressure overshoot control signal to the electrical actuator to move the valve member from the first position to the second position and then back to the first position responsive to an engine load increase determination.

11. The engine system of claim 10, wherein the electronic controller is configured to communicate a depressurization control signal to the electrical actuator to move the valve member from the first position to the second position responsive to an engine off determination.

12. The engine system of claim 11, wherein the electronic controller is configured to communicate a parasitic loss control signal to the electrical actuator to move the valve member from the first position to the second position responsive to an engine low load determination.

13. The engine system of claim 12, wherein the valve member is biased by at least one of the first spring and the second spring toward the first position when the electrical actuator is de-energized.

14. The engine system of claim 12, wherein the valve member is biased by at least one of the first spring and the second spring toward the second position when the electrical actuator is de-energized.

* * * * *